United States Patent [19]

Nahr

[11] 4,069,631

[45] Jan. 24, 1978

[54] BODY ASSEMBLED FROM AT LEAST TWO COMPONENT BODIES

[76] Inventor: Helmar Nahr, Nurnberger Strasse 54, D-8530 Neustadt-Aisch, Germany

[21] Appl. No.: 663,422

[22] Filed: Mar. 3, 1976

[30] Foreign Application Priority Data

| | | |
|---|---|---|
| Mar. 7, 1975 | Germany | 2510060 |
| Oct. 1, 1975 | Germany | 7531106[U] |

[51] Int. Cl.[2] ..... E04G 21/00; E04C 2/26

[52] U.S. Cl. ..... 52/309.5; 49/DIG. 1; 52/403

[58] Field of Search ..... 52/379, 309, 421, 586, 52/425, 403, 426, 427; 49/DIG. 1

[56] References Cited

U.S. PATENT DOCUMENTS

| | | | |
|---|---|---|---|
| 3,156,332 | 11/1964 | Cameron | 49/DIG. 1 |
| 3,393,487 | 7/1968 | Nolan | 49/DIG. 1 |
| 3,517,472 | 6/1970 | Toth | 52/309 X |
| 3,641,730 | 2/1972 | Meckstroth | 52/309 X |
| 3,788,021 | 1/1974 | Husler | 52/379 X |
| 3,823,524 | 7/1974 | Weinstein | 49/DIG. 1 |
| 3,832,818 | 9/1974 | Nahr | 49/DIG. 1 |

FOREIGN PATENT DOCUMENTS

| | | | |
|---|---|---|---|
| 114,221 | 6/1969 | Denmark | 49/DIG. 1 |
| 857,507 | 9/1940 | France | 52/426 |
| 1,489,331 | 6/1967 | France | 49/DIG. 1 |
| 1,454,762 | 8/1966 | France | 49/DIG. 1 |
| 2,010,663 | 9/1971 | Germany | 49/DIG. 1 |
| 2,112,412 | 10/1972 | Germany | 52/403 |

*Primary Examiner*—Leslie Braun

*Attorney, Agent, or Firm*—Wegner, Stellman, McCord, Wiles & Wood

[57] ABSTRACT

A constructional assembly comprising two components connected together by elements to define a cavity, the elements having tapered wedge portions arranged in grooves in the components and having stop faces which engage opposed surfaces in the grooves when a composition is placed in the cavity and expanded.

3 Claims, 7 Drawing Figures

FIG. 4
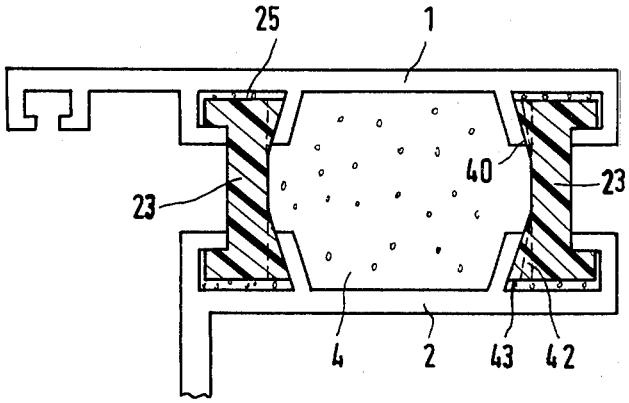
FIG. 7
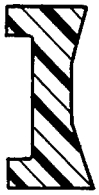
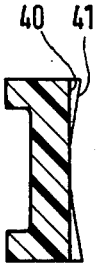
FIG. 6
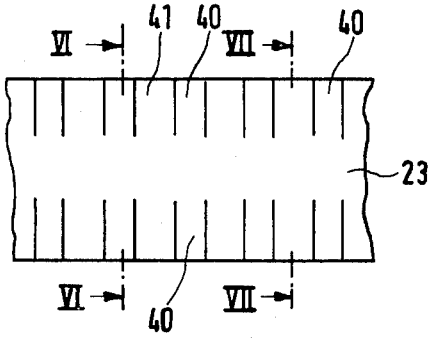
FIG. 5

BODY ASSEMBLED FROM AT LEAST TWO COMPONENT BODIES

BACKGROUND OF THE INVENTION

1. Field of the Invention

This invention relates to a body assembled from at least two component bodies, for example from profiled section rails, having connecting profiled rails which are arranged between the two component bodies and — considered in cross-section — comprise two end thickenings which are pushed with clearance into undercut grooves of the component bodies, having a cavity enclosed between the component bodies and filled with a filling composition which exerts an expansion pressure, whereby the connecting profiled rails are subjected to tension stress, and having abutment faces on the end thickenings which extend substantially perpendicularly of the direction of tension and are intended to abut on the groove undercuttings.

Such composed bodies are used especially for frames of doors and windows. The two component bodies here consist of metal profiled rails; the connecting profiled rails consist of insulating material.

2. Description of the Prior Art

Normally as filling composition a liquid initial product is used which can be caused to foam up by activation, generates an expansion pressure and solidifies. Such an assembled body is a stable structure and has the advantage that the two metal profiled rails are extraordinarily well insulated from one another.

A frequently utilized and known profile form for the connecting profiled rails consists of a stem part having retaining flanges angled off at right angles to one side at its two ends. This profile is called U-profile. A modified form is the E-profile where a nose is also provided in the middle of the stem part. The retaining flanges have stop faces extending perpendicularly of the direction of tension, which are intended to abut on the undercuttings of the grooves.

When such profiled forms are used for the connecting profiled rails however the problem explained below occurs:- The insulating material, preferably hard synthetic plastics material, has a high tensile strength but a low bending strength. If the connecting profiled rail is loaded for example by the glazing pressure, then the stem part does not tear but the retaining flanges bend open and slip out of the undercut grooves of the component bodies. Even before they slip out, a variation of spacing of the component bodies and thus as undesired variation of dimension of the assembled body occur.

A sharp-edged formation of the channels on the connecting profiled rails and of the metal edges engaging therein on the groove neck of the component bodies provides no remedy, because then a notch effect occurs and the connecting profiled rails break long before the tensile strength limit is reached.

Therefore attempts have been made to solve the described problem by the use of connecting profiled rails with double-T-profile. The fundamental idea here is that bending open by simultaneous loading of both flanges on each end of the stem part can be avoided. One disadvantage of this profile form however is a large space requirement for the profile webs on the component bodies which grasp on both sides round the ends of the connecting profiled rails, which requirement leads to difficulties in the frequently narrow window profiles. It is a further disadvantage that with the profile webs on the component bodies surrounding the undercut grooves, relatively large metal surfaces stand at a short distance opposite to one another, whereby the thermal insulation is impaired.

It is a third disadvantage that the expansion pressure of the foaming filling composition acting in the cavity presses the profiled rails outwards, so that only the outer retaining flanges abut fully while the inner ones merely rest on the outermost end and the force distribution is not symmetrical as desired. This again, according to the size of the clearance which the retaining flanges of the connecting profiled rails have in the undercut grooves, can lead to the occurrence of tilting forces and thus to an oblique position of the connecting profiled rails. This results in undesired lateral stagger of the component bodies.

SUMMARY OF THE INVENTION

The object of this invention is to improve the known assembled body to the effect that the spacing of the component bodies is distinguished by a high accuracy of dimension and a lateral stagger of the component bodies is largely excluded.

In accordance with this invention the end thickenings in the region of the groove neck widen in wedge form and are dimensioned so that they abut with close or press fit on the edge of the groove neck, when the stop faces, which extend substantially perpendicularly of the direction of tension, come to abut on the groove undercuttings as a result of the tension force.

The solution according to the invention is based upon the idea that the wedge-shaped widening in the region of the groove neck is to preclude a play in this region, so that it is reliably guaranteed that the metal edge on the groove neck engages in the corresponding channel on the connecting profiled rail, that is to say at the point where the stop face, extending substantially perpendicularly of the direction of traction, issues from the stem part.

Due to the clamping action achieved by means of the conicity it is possible to dispense with the sharp-edged formation of the channel and the metal edge at the groove neck. Instead the channel and the metal edge can be rounded off as appropriate to the material, which leads to the prevention of stress cracks due to notch effect.

The play-free clamping in at the groove neck also guarantees introduction of forces close to the axis of the stem part, whereby bending open of the retaining flanges is effectively prevented. Furthermore as a result of the foam adhesion and/or friction the tapered surfaces of the end thickenings take up not only lateral forces but also forces acting in the direction of tension, whereby a symmetrical introduction of force into the stem part is achieved, if the tapered surfaces and the stop surfaces extending substantially perpendicularly of the axis of tension are situated on opposite sides of the stem part.

Thus the strength of such a connection approaches the tensile strength of the stem part and is thus many times higher than that of a connection based upon flexural rigidity. Thus it is possible to reduce the wall thickness of the stem part, whereby the introduction of forces into the stem part again takes place closer to the axis of the latter and possible asymmetry is diminished.

A practical form of embodiment of an assembled body in which the connecting profiled rails — seen in cross-section — consist of a stem part having a retaining flange angled off approximately at right angles to one side on at least one of its two ends, can consist with utilization of the solution according to the invention in that the stem part has on the side lying opposite to the retaining flange a stop face directed obliquely in relation to the direction of tension and away towards the end of the stem part. In this case it is expediently ensured that the relevant undercut groove has an oblique counter-face corresponding to the oblique stop face on the stem part.

The last-described practical form of embodiment is distinguished by saving of material and space. Since the oblique stop face and the stop face extending perpendicularly of the direction of tension on the end thickening are situated on opposite sides of the stem part, here the extensively symmetrical introduction of forces as indicated already above is guaranteed. The sought effect occurs almost ideally here, since the oblique abutment face presses the channel upon the metal edge of the groove neck on the occurrence of the thrust force.

According to another practical form of embodiment an oblique stop face can also be provided on the side of the stem part to which the retaining flange extends, which stop face then extends between the stem part and the stop face on the retaining flange extending substantially perpendicularly of the direction of tension. Here again it is expedient to provide the relevant undercut groove with a corresponding oblique counter-surface for each oblique stop face on the stem part.

The wedge angle can lie between 10° and 45°, preferably between 15° and 25°. It should be so selected that the expansion pressure of the foaming filling composition is converted into a lateral thrust increased by about 2 to 4 times. If now as known the undercut grooves are formed by profile webs on the component bodies, the profile webs can be dimensioned according to another further development of the invention so that the last-mentioned lateral thrust causes them to yield elastically. Thus a relatively high accuracy of dimension needs to be maintained only as regards the distance between the abutment faces of the connecting profiled rails which extend substantially perpendicularly of the direction of tension, while the ordinary manufacturing tolerances are sufficient for the accuracy of the other dimensions of the undercut grooves and of the connecting profiled rails. In practice the groove neck is simply made somewhat too narrow and this error is compensated by the elastic yield of the metal profiled webs on the component bodies which define the undercut grooves. On account of the need for maintenance of accuracy of dimension of the assembled body this would not be possible if the tapered part of the end thickenings were alone responsible for the abutment, that is if the accuracy of dimension were not guaranteed by the stop faces extending substantially perpendicularly of the direction of tension. There is also the fact that in practice tapered surfaces are more difficult to keep to tolerances than the surfaces extending at right angles to the axis of tension.

As further improvement it is proposed that the connecting profiled rails and/or groove walls on the component bodies are provided in the region of the end thickenings with recesses and/or projections which permit the entry of filling composition from the cavity into the remaining space of the grooves between the groove walls and the end thickenings. The entry of filling composition into the remaining groove space achieves the object that the connecting profiled rails are also completely arrested in the grooves after the setting of the filling composition. It is no longer possible for retaining flanges possibly provided as end thickenings on the connecting profiled rails to bend open into the remaining groove space.

The recesses and/or projections can be formed by milled incisions in the end thickenings and/or groove walls which extend transversely of the longitudinal direction of the connecting profiled rail and have spacing from one another in the mentioned longitudinal direction. The spacing and width of the incisions should be so selected that filling of the remaining groove space with filling composition is reliably guaranteed.

In order to ensure that the component bodies and connecting profiled rails are arrested in relation to one another in the longitudinal direction, projections and recesses on the end thickenings and groove walls can be so dimensioned that they at least partially interengage in tooth manner. In order to guarantee the penetration of filling composition into the remaining groove space however even in this case, by way of example a projection can be omitted alternately or the toothing can be so dimensioned that it does not reach to the full depth.

BRIEF DESCRIPTION OF THE DRAWINGS

FIG. 4 shows a section through an assembled body according to the invention with further improved connecting profiled rails;

FIG. 5 shows a rear view of an improved connecting profiled rail;

FIG. 6 shows a section along the line VI—VI through the improved connecting profiled rail according to FIG. 5; and FIG. 7 shows a section along the line VII—VII through the improved connecting profiled rail according to FIG. 5.

DESCRIPTION OF THE PREFERRED EMBODIMENTS

Figure 1:
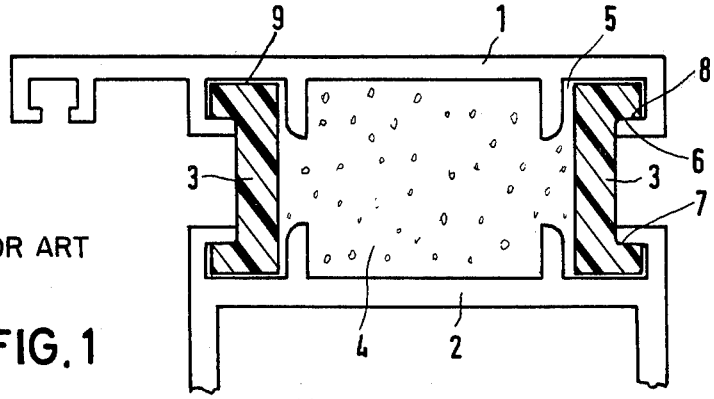
PRIOR ART FIG. 1
FIG. 1 shows a section through an assembled body forming a window/frame member according to the prior art, the connecting profiled rails having a known U-profile.

The assembled body as illustrated in FIG. 1 is a section through a window frame. The body consists of two metal profiled rails 1 and 2 which are provided with undercut grooves 5. Connecting profiled rails consisting of hard synthetic plastics material and composed of a stem part 3 and retaining flanges 9 angled off at right angles are pushed into the undercut grooves 5. The retaining flanges 9 are provided with stop faces 6 which rest on the undercuttings 8 of the grooves. Between the component bodies 1 and 2 and the connecting profiled rails a cavity 4 is enclosed which is filled with a foamed filling composition which exerts an expansion pressure. As a result of this expansion pressure a tension is exerted upon the connecting profiled rails.

Since the flexural rigidity of the hard synthetic plastics material of which the connecting profiled rails consist is less than the tensile strength, the retaining flanges 9 bend open on greater tension loading, whereby the planned distance between the component bodies 1, 2 varies in an undesired manner.

Figure 2:
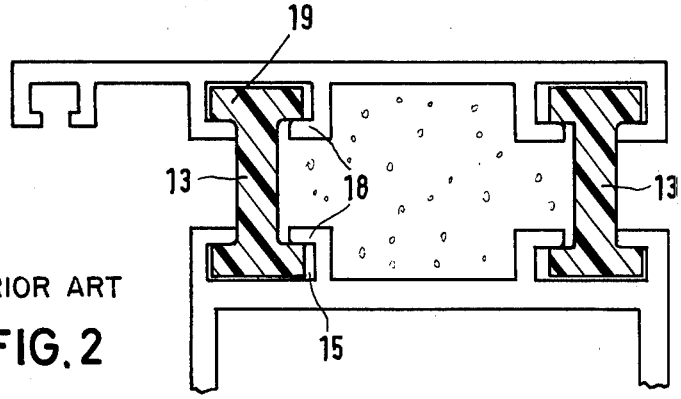
PRIOR ART FIG. 2
FIG. 2 shows a section through an assembled body according to the prior art like FIG. 1, where the connecting profiled rails have a known double-T-profile.

In the form of embodiment according to FIG. 2 the connecting profiled rails consist of a stem part 13 and retaining flanges 19 arranged transversely thereof. The retaining flanges 19 are pushed with clearance into the undercut grooves 15. In this form of embodiment it is disadvantageous that with the profile webs 18 relatively large metal surfaces are opposite to one another at a relatively short distance, whereby the thermal insulation is impaired. There is also the fact that the retaining flanges are asymmetrically loaded, because the foam composition seeks to press the connecting profiled rails outwards. Thus tilting forces can occur which effect an oblique position of the connecting profiled rails. This again has the consequence that the metal profiled rails 1, 2 do not lie one above the other in exact alignment, but shift laterally in relation to one another in an undesired manner.

Figure 3:
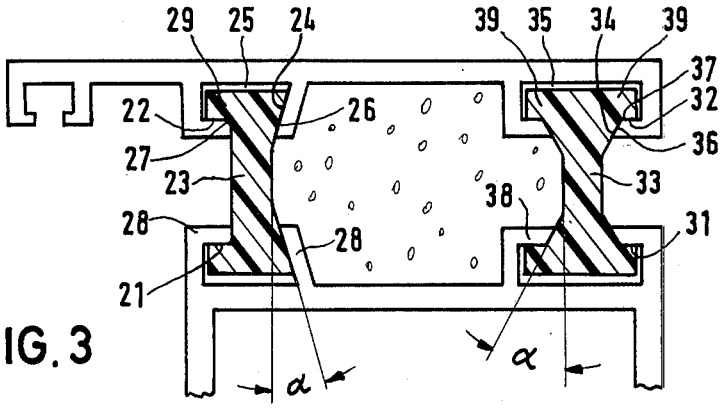
FIG. 3 shows a section like FIG. 1 with two forms of embodiment and two connecting profiled rails formed in accordance with the invention.

In FIG. 3 on the left a first form of embodiment for a connecting profiled rail according to the invention is shown. This consists of a stem part 23 having two retaining flanges 29 angled off at right angles to the same side. Opposite to each retaining flange 29 there is a stop face 26 extending obliquely of the direction of tension.

The undercut grooves are formed by profile webs 28. On the left profile webs undercut surfaces 21 are provided upon which the stop faces 22 are to place themselves. The right profile webs extend obliquely of the direction of tension and have oblique counter-faces 24 for the stop faces 26. The wedge angle of the oblique faces 24 and 26 is $\alpha$. If as a result of the expansion pressure of the filling composition or of the glazing pressure a tension is exerted upon the connecting profiled rail, the oblique stop faces 26 place themselves against the corresponding counterfaces 24 and press the stem part 23 to the left. Then the channel 27 is pressed on to the corresponding edge of the metal web 28 on the groove neck. If the stop face 22 rests on the undercutting surface 21, the tapered region of the connecting profiled rail is seated with close or press fit in the region of the groove neck between the profile webs 28.

In the form of embodiment represented on the right in FIG. 3 the connecting profiled rail consists of a stem part 33 having two retaining flanges 39 extending on both sides. The retaining flanges 39 are seated with clearance in the undercut grooves 35 which are surrounded by the profile webs 38. On the retaining flanges 39 there are stop faces 32 extending substantially perpendicularly of the direction of tension, which rest on the groove undercuttings 31. Between the stop faces 32 and the stem part 33 there extend stop faces 36 extending obliquely of the direction of tension. The taper angle $\alpha$ and the dimensions of the tapered region are so selected that a close or press fit occurs in the region of the groove neck when the stop faces 32 extending at right angles to the axis of tension rest on the groove undercuttings 31. Thus in every case an adjustment against oblique placing of the connecting profile is guaranteed and moreover it is ensured that the corresponding edge of the web profile 38 in the region of the groove neck engages in the channel 37.

In order to guarantee that filling composition can also penetrate into the remaining groove space 25, groove-like milled incisions 40 are provided at regular intervals in the connecting profiled rails 23, between which incisions projections 41 are left. The bottom of the incisions is indicated by the chain line in FIG. 4. FIG. 6 shows a section through a region of the connecting profiled rail 23 represented in FIG. 5, provided with two groove-like incisions 40. FIG. 7 shows a section through a region without groove-like incision, that is through projections 41 remaining between two incisions.

On the right side of FIG. 4 the possibility is indicated that the oblique groove wall may also be provided with projections 42 and incisions 43 which engage in tooth manner, but not to full depth, in the recesses 40 and projections 41 in the end thickenings of the connecting profiled rails. Thus an undesired stagger of the assembled parts in the longitudinal direction is precluded. Since the toothing does not extend to full depth, filling composition can nevertheless penetrate into the remaining groove space 25.

I claim:

1. In a body assembled from at least two component profiled-section metal bodies, having connecting heat-insulating profiled rails arranged between the component bodies each of which in cross section has a stem part and two end thickenings, the latter when pushed with play into undercut grooves of the component bodies form a cavity enclosed between the component bodies and the rails filled with a filling composition exerting an expansion pressure whereby the connecting rails are subjected to tension stress lengthwise of the stems thereof, said rails having stop faces on the end thickenings extending substantially perpendicularly of the tension direction and intended to abut on complementary groove undercuttings, the improvement comprising a stop face formed in the metal section groove opposite said stop face on the end thickenings and oriented at an oblique angle to such tension direction, said end thickening on the said connecting rail having a surface laying at substantially the same oblique angle to such tension direction as said obliquely arranged metal section stop face for engaging same when the perpendicularly arranged stop face and complementary groove undercutting engage, said perpendicularly arranged stop faces and obliquely arranged stop faces being on opposite sides of said connecting rail end thickening to wedge said connecting rail and metal sections together against lateral bending of the rails out of interlocked position with said sections, said end thickenings only partially filling said undercut grooves in the component bodies to provide small recesses between said end thickenings and the groove wall of the component bodies, the connecting profiled rails are provided in the region of the end thickenings with recesses and projections permitting the entry of filling composition from the cavity into the small recesses between the groove wall and the end thickenings for further retaining said stop faces and oblique surfaces of the end thickenings abutting on the complementary groove undercutting and oblique stop face of the metal bodies.

2. A body according to claim 1, in which the recesses and projections are formed by a plurality of milled incisions in the end thickenings extending transversely of the longitudinal direction of the connecting profiled rail and are spaced from one another longitudinally of the rail.

3. A body according to claim 1, in which projections and recesses are formed on the groove walls which interengage with the recesses and projections on the end thickenings to arrest the component bodies and connecting profiled rails in relation to one another in the longitudinal direction of the bodies and rails.

* * * * *